United States Patent [19]

Wulff

[11] 4,045,700

[45] Aug. 30, 1977

[54] X-RAY IMAGE INTENSIFIER

[75] Inventor: Peter Wulff, Erlangen, Germany

[73] Assignee: Siemens Aktiengesellschaft, Berlin & Munich, Germany

[21] Appl. No.: 641,015

[22] Filed: Dec. 15, 1975

[30] Foreign Application Priority Data

Dec. 23, 1974 Germany ..... 2461262

[51] Int. Cl.[2] ..... H01J 1/52

[52] U.S. Cl. ..... 313/242; 250/213 VT; 313/239; 313/313; 313/326

[58] Field of Search ..... 250/213 VT, 213; 313/242, 250, 239, 240, 326, 313

[56] References Cited

U.S. PATENT DOCUMENTS

| | | | |
|---|---|---|---|
| 3,331,979 | 7/1967 | Sybeldon et al. | 313/242 X |
| 3,577,027 | 5/1971 | Szegho | 250/213 VT |
| 3,590,304 | 6/1971 | Moegenbier | 250/213 VT |
| 3,846,654 | 11/1974 | Franz et al. | 313/250 |
| 3,916,240 | 10/1975 | Cuelenaere et al. | 250/213 VT |

*Primary Examiner*—Saxfield Chatmon, Jr.
*Attorney, Agent, or Firm*—Hill, Gross, Simpson, Van Santen, Steadman, Chiara & Simpson

[57] ABSTRACT

An X-ray image intensifier which includes a metal-ceramic bulb or tube, whose metal components are vacuum-tightly soldered to each other under the interposition of the electrically insulating ceramic. Through the weak conductivity of the surface of the ceramic portion there is achieved a potential distribution which, in the neighborhood of the solder, still so extensively conforms to the solder where no potential dropoff will be present and thereby also no reason for the producing of a peak discharge. The potential varies significantly only over longer distances.

4 Claims, 2 Drawing Figures

X-RAY IMAGE INTENSIFIER

FIELD OF THE INVENTION

The present invention relates to an X-ray image intensifier which includes a metal-ceramic bulb or tube, whose metal components are vacuum-tightly soldered to each other under the interposition of the electrically insulating ceramic.

DISCUSSION OF THE PRIOR ART

A problem encountered in that type of image intensifier, in particular when the dimensions thereof are extremely small, is to sufficiently electrically insulate the high-voltage conducting electrodes with respect to each other. It especially causes difficulties in attempting to avoid peak emissions along the edges which are present.

SUMMARY OF THE INVENTION

Accordingly, it is an object of the present invention to provide an X-ray image intensifier which includes a metal-ceramic tube, whose metal components are vacuum-tightly soldered to each other under the interposition of the electrically insulating ceramic, and in which there is avoided the occurrence of peak emissions.

Pursuant to the invention, through the weak conductivity of the surface of the ceramic portion there is achieved a potential distribution which, in the neighborhood of the solder, still so extensively conforms to the solder where no potential dropoff will be present and thereby also no reason for the producing of a peak discharge. The potential varies significantly only over longer distances. However, at any distance there is merely present a smooth surface opposite the counter-electrode, at which there anyway no longer occurs a peak emission.

According to a further known construction, it is considered advantageous that X-ray image intensifiers having receiver screens larger than 120 mm, that a semiconductive coating be formed on the shoulder portion, which interconnects the middle section and the end section of the tube. According to the present invention it has, however, been illustrated in a surprising manner that also for image intensifiers having smaller diameters, an electrically weakly conductive layer is advantageous when the tube consists of a ceramic component, having metallic inlet and outlet components of the tube connected therewith which, in distinction over the prior art, are located at cathode and anode potential.

As a rule, such a ceramic component will come into consideration whose major component is an oxide, such as aluminum oxide. The shape in the neighborhood of the soldering location is suitably so constructed that, for example, a smooth surface is present for a joint or butt solder. In a known manner, the insulating portion may also encompass sequential grooves and raised beads or edges so as to enlarge the surface conductive path. By means of an inventive weak electrically conductive glaze there is obtained through the conductive path there such a setting of the potential distribution on the surface of the ceramic portion, that the uncontrollable charges of the insulating surfaces which are well known from the vacuum tube technology, are avoided, and which could have led to localized increases in the field intensity in a magnitude of a number of tenth powers.

Particularly suitable as glazes are such material or mixtures having dark colors so as to avoid reflections which release disruptive electrons at the photocathode not belonging to the imaging. A glaze which effects both requirements, meaning absorption and conductivity, may have a dark-green color and be constituted of a basic glaze of:

67.9% silica ($SiO_2$),
18.7% aluminum oxide ($Al_2O_3$),
0.2% iron oxide ($Fe_2O_3$),
0.5% magnesium oxide (MgO),
5.0% calcium oxide (CaO),
6.1% potassium oxide ($K_2O$), and
1.6% sodium oxide ($Na_2O$), having added thereto 15 to 30% of its weight a mixture of 50% chromium trioxide ($Cr_2O_3$), 45% iron trioxide ($Fe_2O_3$) and 5% titanium dioxide ($TiO_2$) as coloring body. On the other hand, the basic glaze may, in lieu of the above mixture, also be colored by means of 15 to 30% of a commercial blackener body. Hereby, all percentage figures signify percent by weight.

BRIEF DESCRIPTION OF THE DRAWINGS

Further details and advantages of the invention may now be ascertained from the description of the following exemplary embodiments, taken in conjunction with the accompanying drawings; in which.

DETAILED DESCRIPTION

Figure 1:
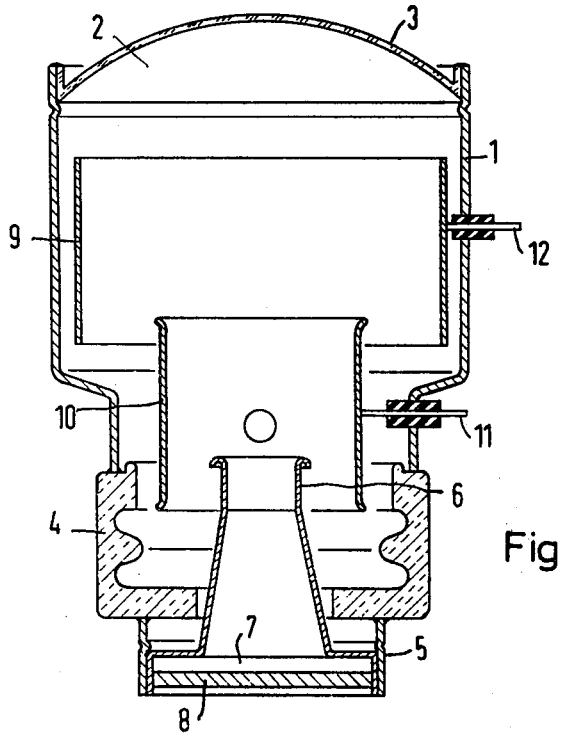
FIG. 1 illustrates a longitudinal sectional view taken through an X-ray image intensifier which includes a metal-ceramic tube.

In FIG. 1 of the drawings, a metal cylinder is designated by reference numeral 1, which is closed off at one end surface thereof by a photocathode 2, the latter of which is located behind a beryllium plate 3 which is inserted into the tube 1 as a vacuum-tight ray-transmissive window. Located at the opposite end of the piston 1 is an insulating part 4 which is formed of ceramic, and to whose one end surface there is butt-soldered the cylinder 1. Soldered to the other end of the insulating part 4 is a short metal cylinder 5, which supports a funnel-shaped cylinder 6 formed of metal and having its smaller opening facing towards the cathode. The funnel is closed off at its larger opening by means of a luminescent or fluorescent screen 7 which is observable through a transparent window 8 vacuum-tightly mounted in the anode. Located between the photocathode and the cylinder 6, which represents the anode, are still two further cylindrically-shaped electrodes 9 and 10. The current supply or infeed is carried out directly on cylinder 1 for the cathode 2, at an inlet connector 11 for the cylinder 9, at an inlet connector 12 for the cylinder 10, and for the anode 6 directly from externally on the metal component 5.

The applied voltages are hereby so distributed that electrons, which are released in the photocathode 2 by the X-rays entering through the window 3, and produced between 2, 9, 10 and 6 through the applied potential differences, are reproduced on the luminescent screen 7. The luminescent image which is produced through the impacting of the electrons on screen 7, can be observed through the window 8, photographed, and so forth. As is known, the observation may have connected ahead thereof an electronic processing, such as television and the like.

Figure 2:
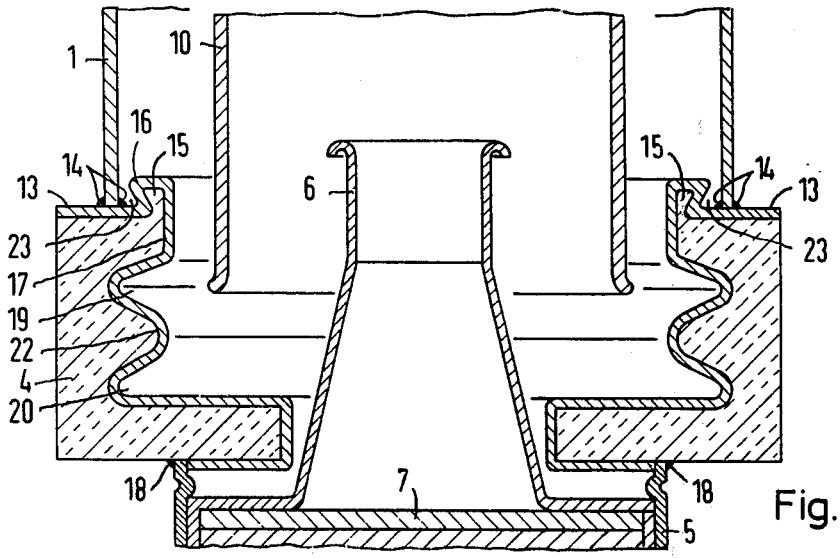
FIG. 2 shows an enlarged fragmentary section of FIG. 1 taken through the ceramic insulator electrically separating the cathode and the anode, from each other.

The construction of the ceramic component 4 in conformance with the concept of the invention may be particularly ascertained from the enlarged scale representation in FIG. 2 of the drawings. Therein is clearly indicated that at the location at which the cylinder is butt-soldered onto the ceramic insulator 4, a solder layer 13 is present on which there is seated the cylinder 1. At its contacting locations it is vacuum-tightly connected through intermediary of the solder 14. Towards the electrode 10, the ceramic component is drawn up into a raised bead 15. The latter is additionally a nose 16 bent over onto the cylinder 1 bent, as may be ascertained in the section from the drawing. A recess is thereby obtained which encompasses the inner solder portion 14 so that the shortest direct path between 14 and the oppositely charged electrode 10 is mechanically closed off through intermediary of the insulator 4.

Applied to the inner surface of the ceramic portion 4 is an approximately 50 μm thick layer 17. This is a glaze formed of the mixture as described hereinabove which, in addition to the basic glaze, contains 20% of the chromium, iron, and titanium oxide coloring body. The glaze leads up to the lower end of the ceramic portion. Here it covers only the internal surface. At the external surface of insulator 4, the glaze has principally the same effect and may be utilized for avoiding of flash-over across the insulator 4 under a casting mass applied for insulation.

Soldered to the lower end of the ceramic portion 4 is the closing metal component 5, whereby the soldering locations are designated by reference numerals 18. Here no particular protective screening is required since no potential opposite to further electrodes is present in the neighborhood.

Through the shaping, meaning on the one hand through the raised bead 15 and the projection or nose 16, as well as on the other hand, through the annular recesses 19 and 20 located at the inner side, and an intermediate bead 22, the spacing between the two ends of the portion 4 is suitably adjusted. This results in that, at the surface of the inside of the ceramic portion 4, the potential distribution is so provided that in the space lying between 14 and the recess 23 no aspirating field distribution with respect to 14 can be caused by the electrode 10. Thereby, the construction of an image intensifier can become extremely small. This is of particular importance when it is necessary to use sideways the minimum possible space for insulating spacers, as is important for example, for image intensifiers used in mammoscopy.

While there has been shown what is considered to be the preferred embodiment of the invention, it will be obvious that modifications may be made which come within the scope of the disclosure of the specification.

What is claimed is:

1. In an x-ray image intensifier having a vacuum-tight metal-ceramic tube including an interposed electrically insulating ceramic component (4), an electrically weakly conductive layer (17) covering the surface of said ceramic component (4) at least on the side facing interiorly of said tube, the tube having first and second concentric metal cylinders (1, 10), the first metal cylinder (1) having an end thereof butt-soldered to the ceramic component (4) and the second metal cylinder (10) being located inside said first metal cylinder (1) and inside of the ceramic component (4), said ceramic component (4) being joined to said first metal cylinder (1) along a juncture line, and a raised bead (15) located on the ceramic component (4) along the juncture line of said first metal cylinder (1) with said ceramic component (4) and between said first and second metal cylinders (1, 10).

2. An X-ray image intensifier as claimed in claim 1, said layer (17) comprising a glaze constituted of a basic glaze and a coloring body.

3. In an X-ray image intensifier having a metal-ceramic tube, the metal components of said tube being vacuum-tightly soldered to each other under the interposition of an electrically insulating ceramic component, the improvement comprising: an electrically weakly conductive layer covering the surface of said ceramic component at least on the side facing interiorly of said tube, said layer comprising a glaze constituted of a basic glaze and a coloring body, said layer comprising a mixture of a basic glaze constituted of about 67.9% silica ($SiO_2$), 18.7% aluminum oxide ($Al_2O_3$), 0.2 iron oxide ($Fe_2O_3$), 0.5 magnesium oxide (MgO), 5.0% calcium oxide (CaO), 6.1% potassium oxide ($K_2O$), and 1.6% sodium oxide ($Na_2O$); and including 15 to 30% additive of a dark-colored coloring body relative to the quantity of said basic glaze.

4. An X-ray image intensifier as claimed in claim 3, said coloring body being constituted of 50% chromium trioxide ($Cr_2O_3$), 45% iron trioxide ($Fe_2O_3$), and 5% titanium dioxide ($TiO_2$).

* * * * *